US006699041B1

(12) United States Patent
Larkin et al.

(10) Patent No.: US 6,699,041 B1
(45) Date of Patent: Mar. 2, 2004

(54) SELF-ASSESSING TARGET WITH AUTOMATIC FEEDBACK

(75) Inventors: Stephen W. Larkin, West Mifflin, PA (US); Robert L. Kramer, Everson, PA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 10/289,872

(22) Filed: Nov. 7, 2002

(51) Int. Cl.[7] ..... F41G 3/26
(52) U.S. Cl. ..... 434/16; 434/19
(58) Field of Search ..... 434/11, 16, 17, 434/19, 20, 21, 22

(56) References Cited

U.S. PATENT DOCUMENTS 4,820,161 A * 4/1989 Wescott ..... 434/16
4,955,812 A * 9/1990 Hill ..... 434/16
5,095,433 A * 3/1992 Botarelli et al. ..... 273/372
5,437,463 A * 8/1995 Fromm ..... 463/5
5,551,876 A * 9/1996 Koresawa et al. ..... 434/16
5,577,733 A * 11/1996 Downing ..... 273/348
6,322,365 B1 * 11/2001 Shechter et al. ..... 434/21
6,575,753 B2 * 6/2003 Rosa et al. ..... 434/16

* cited by examiner

*Primary Examiner*—Kurt Fernstrom
(74) *Attorney, Agent, or Firm*—Julia Cook Moody; Paul A. Gottlieb

(57) ABSTRACT

A self assessing target with four quadrants and a method of use thereof. Each quadrant containing possible causes for why shots are going into that particular quadrant rather than the center mass of the target. Each possible cause is followed by a solution intended to help the marksman correct the problem causing the marksman to shoot in that particular area. In addition, the self assessing target contains possible causes for general shooting errors and solutions to the causes of the general shooting error. The automatic feedback with instant suggestions and corrections enables the shooter to improve their marksmanship.

20 Claims, 9 Drawing Sheets

Shots are going high and to the strong side:

1. Anticipating the gun's recoil. The proper way to shoot a gun is to not worry about recoil at all.

Solution: *Maintain a proper grip without moving before, during and immediately after each shot.*

2. Too much pressure with the strong hand thumb. If you apply too much pressure with the strong hand thumb, you will push shots off to the strong side, usually high.

Solution: *Lessen thumb pressure while still maintaining proper grip.*

FIG. 2

Shots are going high and to the weak side:

1. Pulling on the gun while firing. If you pull back on the gun while firing, your shots will end up high above the point of aim.

Solution: *Maintain proper follow-through while firing. Don't let your wrist, elbow or shoulder bend up.*

2. Breaking the wrist up. If your wrist is bent upward, your shots will go high.

Solution: *Wrist should be parallel with your forearm.*

FIG. 3

Shots are going low and to the strong side:

1. Tightening the whole hand shut along with the trigger pull. If you spasmodically squeeze the whole hand tight while pressing the trigger, you will cause the shots to go to the strong side (and usually low), as the whole hand pushes it forcefully in that direction.

Solution: *Keep your shooting hand strongly gripping the gun, while keeping the trigger finger relaxed. Before beginning the trigger pull, grip the gun as tightly as you can so that you cannot abruptly squeeze it any stronger before the shot.*

2. Limp wrist during firing. If your wrist is limp it will cause your shots to end up low and to the strong side, and can cause failure to feed with an automatic.

Solution: *Before firing, tighten your grip. Make sure that your wrist is good and stiff. If the muscles in your forearm are tense, your wrist is stiff. If they are not, your wrist will be too slack.*

FIG. 4

Shots are going low and to the weak side:

1. Trigger flinch. If you flinch you will jerk the gun in anticipation of recoil.

Solution: *Relax. Don't anticipate the round going off.*

2. Breaking the wrist downward. If your wrist is bent downward, your shots will be low.

Solution: *Make a conscious effort to keep your wrist straight. Don't make last-second adjustments as you are pulling the trigger.*

3. Concentration, then relaxing before the trigger has been pulled will cause shots to go low.

Solution: *Maintain proper follow-through.*

FIG. 5

Shots are going to the weak side:

1. Trigger finger is not in far enough. If your trigger finger is not inserted far enough the shot will usually go to the weak side as you "push" the gun slightly in that direction.

Solution: *Set finger properly. For single-action, the middle of the first pad should contact the center of the trigger. For double-action, the finger should be inserted all the way to the first joint.*

2. Pulling too hard with the weak hand. The weak hand is pushed into and used as a brace by the gun hand. If you pull too hard with the weak hand the shots will go to the weak side.

Solution: *While shooting, concentrate on applying only the appropriate amount of pressure.*

FIG. 6

Shots are going to the strong side:

1. Trigger finger pushed too far. If your finger is inserted too far the shots will usually go to the strong side as you "pull" the gun slightly in that direction.

Solution: *Ensure your finger is situated properly. For single-action the center of the first pad should be contacting the center of the trigger. For double-action the finger should be inserted all the way to the first joint.*

2. Applying too much pressure with the ball of the weak hand. If you apply too much pressure with your weak hand against the gun shots will be pushed off the strong side and a little high.

Solution: *Do not apply lateral pressure with the support hand.*

FIG. 7

Shots stringing - vertical or horizontal:

1. Moving the body vertically while shooting. If you move your body while shooting vertical stringing will result.

Solution: *Remain still while shooting. Pay attention to your knees and shoulders. These two locations are usually the culprits.*

2. Breathing while shooting. If you take unusually large breaths while shooting a handgun you can affect your accuracy.

Solution: *Control your breathing by taking several deep breaths, then holding your breath while shooting. Breathe between shots.*

3. Moving the body horizontally while shooting. If you swing your entire body while shooting. If you swing your entire body, or part of it, horizontally it will result in a corresponding string of hits on your target.

Solution: *Remain still while shooting. Pay attention to your knees and shoulders. These two locations are usually the culprits.*

FIG. 8

Shots are scattered all oer the target:

1. Not focusing on a specific part of the target will often result in shots scattered all over the target. Also, shifting focus to a different part of the target will result in scattered shots.

Solution: *Take care to always maintain aim on the exact part of the target you want to hit, and do this for every shot.*

FIG. 9

SELF-ASSESSING TARGET WITH AUTOMATIC FEEDBACK

BACKGROUND OF THE INVENTION

The United States Government has rights in this invention pursuant to a contract with the U.S. Department Energy.

1. Field of the Invention

The present inventive subject matter relates to a target device including a surface having thereon indicia which define points of aim or define the portion of the surface adapted to be struck by a projectile. More particularly, the present invention relates to a target which provides automatic feedback to the shooter enabling the shooter to improve their marksmanship.

2. Description of the Related Art

Shooting targets are commonly used for recreational purposes and in the training of police officers and marksmen. Considerable effort has been put forth to create devices which provide immediate feedback to the user indicating the success of his or her shot. Such devices allow the marksman to make immediate corrective action, and thereby spend his or her time more productively.

Many prior art targets which provide immediate feedback employ electrical self-indicating targets signaling the zone bit by the projectile. Other prior art targets are used in the calibration of telescopic sights or for use in testing accuracy of firearms.

In general, the problem with prior art targets is the lack of feedback in the form of suggestions and corrections which would enable the shooter to improve their marksmanship.

U.S. Pat. No. 6,213,470 discloses a sighting target for positioning at various fixed distances for calibration of a telescopic sight on a firearm such as a pistol, rifle and the like. The target has an X positioned against a white background having square grids with black lines. The stripes are colored orange with black edges. At the intersection, a circle is delineated in black. The ends of the X do not terminate at the comers of the target, but terminate proximate to the vertical edges. The X of the cross hairs of the telescopic sight is aligned with the X of the target in an efficient and effective manner for a specific distance.

U.S. Pat. No. 4,177,580 discloses a target system which is responsive to and indicative of the hits and areas of near miss of laser light pulses that have been shot from a laser weapon aimed at the target system, be it a simulated gun or other device, by a marksman. In addition to the bull's-eye indicia on the face of the target system, the target system comprises a quadrant arrangement of laser light detectors that are located on the front of the target system in such manner as to permit them to sense the laser light pulses. The detectors are connected in combination with data processing channels, programmed timers, a preprogrammed read only memory logic circuit, and an array of lights disposed around and near the perimeter of the target face. The latter mentioned lights light up in accordance with the approximate location of the hits of the laser light pulses relative to the bull's-eye of the target face, thereby indicating either a hit or the direction of a near miss to the marksman.

U.S. Pat. No. 4,949,972 discloses an automatic target shooting system for determining projectile location relative to a target, calculating a score based upon the location and displaying a replica of the target with an indication of the location of the projectile relative to the target and the score. A target support structure defines a target area with criss-crossing X-Y-type coordinate light beams extending between light emitter devices and light receiving devices which generate output signals indicative of the location of a projectile during passage through the target area. The output signals are utilized by a computer device to identify the location of the projectile relative to the target and score the shot in accordance with the location. A replica of the target is displayed on a CRT screen with an indication of the location of the shot thereon and the score for the shot.

U.S. Pat. No. 4,786,058 discloses an electric indicating target for use in shooting practice which provides a user with a display indicating the zone of the target face that has been hit by a shot. The target includes a planar surface of electrical resistance elements formed on the target face and divided into a plurality of electrically insulated sectors. When the surface of a sector is penetrated by a relatively small projectile, the resistance of the sector increases by an amount indicative of a shot hitting the sector. The target further includes external circuits, each connected to a different sector of the target, that store the resistance of a sector and detect changes in this resistance indicative of a projectile hitting the sector. After a sector is hit, the associated circuit first signals so, and then stores the new resistance of the sector. A display device is connected to the external circuitry in order to provide a user with messages indicating which sector has been hit.

U.S. Pat. No. 2,417,451 discloses an instruction target sheet for sighting and testing the accuracy of rifles and small arms on a testing range. The target sheet comprises a conventional target pattern including a sighting bull's-eye superimposed thereon. Surrounding the bull's-eye are a number of concentric rings providing various scoring zones of value diminishing outwardly from the center. A sighting bull's-eye is superimposed on the conventional target sheet in order to facilitate ease in aligning the vertical aspect of the shot. The size of the superimposed sighting bull's-eye is determined by the marksman's distance to the target.

U.S. Pat. No. 197,397 discloses a target sheet for exhibiting the distribution of a gun shot and the character of the distribution due to either gun, powder or shot. The target sheet comprises a series of circles whose centers are arranged around and off the center of a main circle and divided into a series of spaces by cross lines, thereby permitting the marksman to ascertain the position and distribution of hits on the target sheet.

However, there remains a need for a target device which provides automatic feedback to the shooter, to enable the shooter to improve their marksmanship. In addition, there is a need for a target device that provides immediate feedback in the form of suggestions and corrections which enable the shooter to improve their marksmanship.

BRIEF SUMMARY OF THE INVENTION

One embodiment of the present inventive subject matter is drawn to a target for use by a marksman in shooting practice comprising: a substantially planar member, said substantially planar member divided into four quadrants, an upper-right quadrant, an upper-left quadrant, an lower-right quadrant and an lower-left quadrant; a center mass area on said substantially planar member at which said marksman aims, said center mass located at the intersection of said four quadrants; and a plurality of analysis boxes, wherein each of said analysis boxes contains a text that contains analysis and solutions to errors of a marksman using said target.

Another embodiment of the present invention is a method for providing automatic feedback in target shooting comprising the steps of: firing projectiles from a firearm at a target, said target containing a center mass at which said projectiles are aimed, said target further divided into four quadrants, an upper-right quadrant, an upper-left quadrant, an lower-right quadrant and an lower-left quadrant, wherein intersection of said four quadrants is located in said center mass, said target further containing a plurality of analysis boxes, wherein each said analysis boxes contains text with analysis and solutions to errors in marksmanship; evaluating the location where said projectiles stuck said target; correcting said error in marksmanship using information provided in said analysis boxes.

BRIEF DESCRIPTION OF THE DRAWINGS

FIG. 2 illustrates possible causes for shots going high and to the strong side of the marksman along with solutions for correcting such shots.

FIG. 3 illustrates possible causes for shots going high and to the weak side of the marksman along with solutions for correcting such shots.

FIG. 4 illustrates possible causes for shots going low and to the strong side along with solutions for correcting such shots.

FIG. 5 illustrates possible causes for shots going low and to the weak side of the marksman along with solutions for correcting such shots.

FIG. 6 illustrates possible causes for shots going to the weak side of the marksman along with solutions for correcting such shots.

FIG. 7 illustrates possible causes for shots going to the strong side of the marksman along with solutions for correcting such shots.

FIG. 8 illustrates possible causes for shots stringing vertically or horizontally along with solutions for correcting such shots.

FIG. 9 illustrates possible causes for shots scattered all over the target along with solutions for correcting such shots.

DETAILED DESCRIPTION OF THE PREFERRED EMBODIMENT

Figure 1:
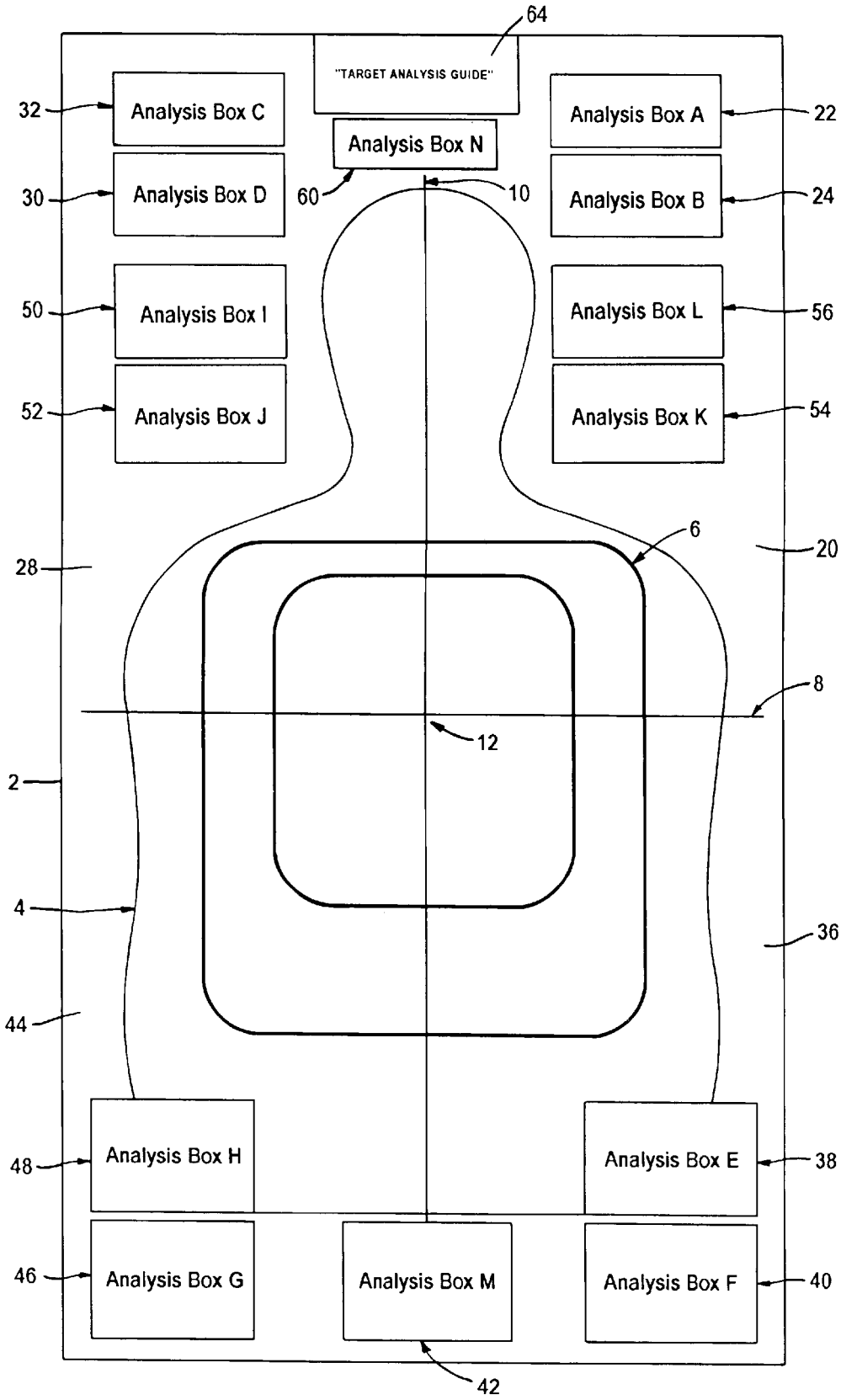
FIG. 1 illustrates the target with four separate quadrants which includes Analysis Boxes that list possible causes for shooting errors and corresponding solutions.

The preferred embodiment of the subject invention will Dow be discussed in some detail in conjunction with all of the figures, wherein like parts are designated by like reference numerals, insofar as it is possible and practical to do so. While the present inventive subject matter is applicable for use with semi-automatic handguns, revolvers as well as other small arms including rifles, semi-automatic rifles and the like, the preferred embodiment, discussed below, is a self assessing target used by marksmen firing semi-automatic handguns with two hands. In the present invention a marksman aims each shot at the center mass of a target. The target of the present invention is broken into four quadrants with the intersection of the four quadrants being located in the center mass of the target. Each quadrant is labeled with possible causes as to why shots are going into that particular quadrant instead of center mass. Each possible cause is followed by solutions to assist in correcting the problem which is causing the marksman to shoot in that particular quadrant. Further, additional text boxes identifying causes and providing solutions for general shooting errors are provided. Examples of such errors include stringing shots vertically or horizontally, shots going high or low and shots scattered all over the target. The present invention provides target analysis for both left and right handed marksman. Further, the target analysis provides causes and solutions for both strong and weak side errors. A right-handed marksman hitting the target on the right side would be an example of a shooting error to the marksman's strong side. A right-handed marksman hitting the target on the left side would be an example of a shooting error to the right-handed marksman's weak side. In one embodiment, analysis is provided in the Analysis Boxes in different colors to help the marksman easily identify which analysis applies. For example, Analysis Boxes for right-handed marksman may be printed in a first color, text in Analysis Boxes for a left-handed marksman may be printed in a second color and text in Analysis Boxes for use by both night and left-handed marksmen may be printed in a third color. Various colors may be used without limitation. For example, colors may be selected from a group consisting of: red, blue, yellow, green, black, purple, orange, brown, pink, gray or white without limitation of the choices of color to those listed. Referring now to FIG. 1, there is shown a target sheet 2 with a human silhouette 4 located on target sheet 2. At least one target box 6 is located on human silhouette 2. Target sheet 2 is broken into four separate quadrants, upper-right quadrant 20, upper-left quadrant 28, lower-right quadrant 36 and lower-left quadrant 44 by horizontal line 8 and vertical line 10. Center mass 12 of target sheet 2 is located at the intersection of horizontal line 8 and vertical line 10. The marksman aims each shot at center mass 12 of the target sheet 2.

In the event that a right-handed marksman's shots are located in upper-right quadrant 20 of target sheet 2, the marksman may refer to Analysis Box A 22, as summarized in FIG. 2, for analysis and solutions for improving marksmanship. As can be seen in FIG. 2, a cause for hitting target sheet 2 in upper-right quadrant 20 for a right-handed marksman is anticipating the semi-automatic handgun's recoil which may be corrected by maintaining a proper grip without moving before, during and after each shot. Also seen in FIG. 2, another cause for hitting target sheet 2 in upper-right quadrant 20 for a right-handed marksman is placing too much pressure on the semi-automatic handgun with the strong hand thumb which may be corrected by lessening thumb pressure while maintaining the proper grip.

For left-handed marksman whose shots are located primarily in upper-right quadrant 20 of target sheet 2, the marksman may refer to Analysis Box B 24, as summarized in FIG. 3, for analysis and solutions for improving marksmanship. As can be seen in FIG. 3, one of the causes for hitting target sheet 2 in upper-right quadrant 20 for a left-handed marksman is pulling back on the semi-automatic handgun while firing which may be corrected by maintaining a proper follow through while firing. Also seen in FIG. 3, another cause for hitting target sheet 2 in upper-right quadrant 20 for a left-handed marksman is breaking the wrist up which may be corrected by keeping the wrist parallel with the forearm.

In the event that a left-handed marksman's shots are located in upper-left quadrant 28 of target sheet 2, the marksman may refer to Analysis Box D 30, as summarized in FIG. 2, for analysis and solutions for improving marksmanship. As can be seen in FIG. 2, a cause for hitting target sheet 2 in upper-left quadrant 28 for a left-handed marksman is anticipating the semi-automatic handgun's recoil which may be corrected by maintaining a proper grip without moving before, during and after each shot. Also seen in FIG. 2, another cause for hitting target sheet 2 in upper-left quadrant 28 for a right-handed marksman is placing too much pressure on the semi-automatic handgun with the strong hand thumb which may be corrected by lessening thumb pressure while maintaining the proper grip.

For right-handed marksman whose shots are located primarily in upper-left quadrant 28 of target sheet 2, the marksman may refer to Analysis Box C 32, as summarized in FIG. 3, for analysis and solutions for improving marksmanship. As can be seen in FIG. 3, one of the causes for hitting target sheet 2 in upper-left quadrant 28 for a left-handed marksman is pulling back on the semi-automatic handgun while firing which may be corrected by maintaining a proper follow through while firing. Also seen in FIG. 3, another cause for hitting target sheet 2 in upper-left quadrant 28 for a left-handed marksman is breaking the wrist up which may be corrected by keeping the wrist parallel with the forearm.

In the event that a right-handed marksman's shots are located in lower-right quadrant 36 of target sheet 2, the marksman may refer to Analysis Box E 38, as summarized in FIG. 4, for analysis and solutions for improving marksmanship. As can be seen in FIG. 4, a cause for hitting target sheet 2 in lower-right quadrant 36 for a right-handed marksman is tightening the whole hand shut along with the trigger pull which may be corrected by keeping the shooting strongly gripping the semi-automatic handgun while keeping the trigger finger relaxed. Also seen in FIG. 4, another cause for hitting target sheet 2 in lower-right quadrant 36 for a right-handed marksman is a limp wrist during firing which may be corrected by tightening the grip.

For left-handed marksman whose shots are located primarily in lower-right quadrant 36 of target sheet 2, the marksman may refer to Analysis Box F 40, as summarized in FIG. 5, for analysis and solutions for improving marksmanship. As can be seen in FIG. 5, one of the causes for hitting target sheet 2 in lower-right quadrant 36 for a left-handed marksman is trigger flinch which may be corrected by relaxing and not anticipating the round going off. Also seen in FIG. 5, other causes for hitting target sheet 2 in lower-right quadrant 36 for a left-handed marksman is breaking the wrist downward which may be corrected by making a conscious effort to keep the wrist straight and relaxing before the trigger pull which may be corrected by maintaining the proper follow through.

In the event that a right-handed marksman's shots are located in lower-left quadrant 44 of target sheet 2, the marksman may refer to Analysis Box G 46, as summarized in FIG. 4, for analysis and solutions for improving marksmanship. As can be seen in FIG. 4, a cause for hitting target sheet 2 in lower-left quadrant 44 for a left-handed marksman is tightening the whole hand shut along with the trigger pull which may be corrected by keeping the shooting strongly gripping the semi-automatic handgun while keeping the trigger finger relaxed. Also seen in FIG. 4, another cause for hitting target sheet 2 in lower-left quadrant 44 for a left-handed marksman is a limp wrist during firing which may be corrected by tightening the grip.

For right-handed marksman whose shots are located primarily in lower-left quadrant 44 of target sheet 2, the marksman may refer to Analysis Box H 48, as summarized in FIG. 5, for analysis and solutions for improving marksmanship. As can be seen in FIG. 5, one of the causes for hitting target sheet 2 in lower-left quadrant 44 for a right-handed marksman is trigger flinch which may be corrected by relaxing and not anticipating the round going off. Also seen in FIG. 5, other causes for hitting target sheet 2 in lower-left quadrant 44 for a right-handed marksman is breaking the wrist downward which may be corrected by making a conscious effort to keep the wrist straight and relaxing before the trigger pull which may be corrected by maintaining the proper follow through.

In the event that a right-handed marksman's shots are located in lower-left quadrant 44 and upper-left quadrant 28 of target sheet 2, the marksman may refer to Analysis Box I 50, as summarized in FIG. 6, for analysis and solutions for improving marksmanship. As can be seen in FIG. 6, one of the causes for hitting target sheet 2 in lower-left quadrant 44 and upper-left quadrant 28 for a right-handed marksman is marksman's trigger finger is not in far enough which may be corrected by properly setting the trigger finger. Also seen in FIG. 6, another cause for hitting target sheet 2 in lower-left quadrant 44 and upper-left quadrant 28 for a right-handed marksman is pulling too hard with marksman's weak hand which may be corrected by concentrating on placing the appropriate amount of pressure with the weak hand while shooting.

For left-handed marksman whose shots are located primarily in lower-left quadrant 44 and upper-left quadrant 28 of target sheet 2, the marksman may refer to Analysis Box J 52, summarized in FIG. 7, for analysis and solutions for improving marksmanship As can be seen in FIG. 7, hitting target sheet 2 in lower-left quadrant 44 and upper-left quadrant 28 for a left-handed marksman may be caused by the marksman's trigger finger being pushed in too far which may be corrected by properly setting the trigger finger. Also seen in FIG. 7, another cause for hitting target sheet 2 in lower-left quadrant 44 and upper-left quadrant 28 for a left-handed marksman is applying too much pressure with the ball of the marksman's weak hand which may be corrected by not applying lateral pressure with the weak hand.

If a left-handed marksman's shots are located in lower-right quadrant 36 and upper-right quadrant 20 of target sheet 2, the marksman may refer to Analysis Box K 54, as summarized in FIG. 6, for analysis and solutions for improving marksmanship. As can be seen in FIG. 6, one of the causes for hitting target sheet 2 in lower-right quadrant 36 and upper-right quadrant 20 for a left-handed marksman is marksman's trigger finger is not in far enough which may be corrected by properly setting the trigger finger. Also seen in FIG. 6, another cause for hitting target sheet 2 in lower-right quadrant 36 and upper-right quadrant 20 for a left-handed marksman is pulling too hard with marksman's weak hand which may be corrected by concentrating on placing the appropriate amount of pressure with the weak hand while shooting.

For right-handed marksman whose shots are located primarily in lower-right quadrant 36 and upper-right quadrant 20 of target sheet 2, the marksman may refer to Analysis Box L 56, summarized in FIG. 7, for analysis and solutions for improving marksmanship. As can be seen in FIG. 7, one of the causes for hitting target sheet 2 in lower-right quadrant 36 and upper-right quadrant 20 .for a right-handed marksman is marksman's trigger finger is pushed in too far which may be corrected by properly setting the trigger finger. Also seen in FIG. 7, another cause for hitting target sheet 2 in lower-right quadrant 36 and upper-right quadrant 20 for a right-handed marksman is applying too much pressure with the ball of the marksman's weak hand which may be corrected by not applying lateral pressure with the weak band.

In the event that a right or left handed marksman's shots are stringing vertically or horizontally, the marksman may refer to Analysis Box M 58, as summarized in FIG. 8, for analysis and solutions for improving marksmanship. As can be seen in FIG. 8 a reason for stringing shots vertically is the marksman moving his or her body vertically while shooting which may be corrected by keeping still while shooting, paying particular attention to the knees and shoulders. Also seen in FIG. 8, another reason for stringing shots vertically or horizontally is breathing while shooting which may be corrected by taking breaths between shots and holding one's breath while shooting. Also seen in FIG. 8, a cause for string shots horizontally is the marksman moving his or her body horizontally while shooting which may be corrected by keeping still while shooting, paying particular attention to the knees and shoulders.

In the event that a right or left handed marksman's shots arc scattered all over the target sheet 2, the marksman may refer to Analysis Box N 60, as summarized in FIG. 9, for analysis and solutions for improving marksmanship. As summarized in FIG. 9, scattering shots all over the target can be caused by not focusing on a specific part of target 2 which may be corrected by maintaining aim on the exact part of target sheet 2 the marksman wishes to hit.

In one embodiment of the present invention, Analysis Boxes A 22, C 32, E 38, H 48, I 50, L 56 with analysis and solutions for right-handed marksmen are printed in the same color of ink. The Analysis Boxes B 24, D 30, F 40, G 46, J 52, K 54 with analysis and solutions for a left-handed marksmen are printed in the same color which is different than that used for right-handed marksmen. Further, Analysis Boxes M 58 and N 60 which contain analysis and solutions for marksmen without regard to right or left handedness are printed in the same color which is different than the colors used for analysis and solutions for either Tight or left handed marksmen.

In the preferred embodiment, Analysis Boxes A 22, C 32, E 38, H 48, I 50, L 56 with analysis and solutions for right-handed marksmen are printed in red, analysis B 24, D 30, F 40, G 46, J 52, K 54 with analysis and solutions for left-handed marksmen are printed in blue and Analysis Boxes M 58 and N 60 with analysis and solutions for marksmen without regard to right or left handedness are printed in black.

In one of the preferred embodiments, a legend 64 printed on target sheet 2 provides a key to colors used within target sheet 2.

The invention being thus described, it will be obvious that the same may be varied in many ways. Such variations are not to be regarded as a departure from the spirit and scope of the invention and all such modifications are intended to be included within the scope of the following claims.

We claim:

1. A target for use by a marksman in shooting practice comprising:

a substantially planar member, said substantially planar member divided into four quadrants, an upper-right quadrant, an upper-left quadrant, an lower-right quadrant and an lower-left quadrant;

a center mass area on said substantially planar member at which said marksman aims, said center mass located at the intersection of said four quadrants; and a plurality of analysis boxes, wherein each of said analysis boxes contains a text that contains analysis and solutions to errors of a marksman using said target.

2. The target of claim 1, wherein said target is for use by marksmen using a firearm selected from a group consisting of: semi-automatic handguns, revolver handguns, rifles, assault rifles and machine guns.

3. The target of claim 2, wherein said firearm is a semi-automatic handgun.

4. The target of claim 3, wherein said plurality of Analysis Boxes provide analysis and solutions for semi-automatic handgun users shooting with at least one hand.

5. The target of claim 4, wherein said plurality of Analysis Boxes include at least one Analysis Box for a right-handed marksman and at least one Analysis Box for a left-handed marksman.

6. The target of claim 5, wherein said text in said Analysis Boxes for said right-handed marksmen is printed in a first color, said text in said Analysis Boxes for said left-handed marksmen is printed in a second color and said text in said Analysis Boxes for both said right and left-handed marksmen is printed in a third color.

7. The target of claim 6, wherein said target contains a legend.

8. The target of claim 1, wherein said target has a human silhouette on which said center mass is located.

9. The target of claim 8, wherein at least one target box is contained on said human silhouette.

10. The target of claim 1 wherein said plurality of Analysis Boxes include at least one Analysis Box which contains analysis and solutions for shots that go high and to a strong side of said marksman.

11. The target of claim 1 wherein said plurality of Analysis Boxes include at least one Analysis Box which contains analysis and solutions for shots that go high and to a weak side of said marksman.

12. The target of claim 1 wherein said plurality of Analysis Boxes include at least one Analysis Box which contains analysis and solutions for shots that go low and to a strong side of said marksman.

13. The target of claim 1 wherein said plurality of Analysis Boxes include at least one Analysis Box which contains analysis and solutions for shots that go low and to a weak side of said marksman.

14. The target of claim 1 wherein said plurality of Analysis Boxes include at least one Analysis Box which contains analysis and solutions for shots that go to a weak side of said marksman.

15. The target of claim 1 wherein said plurality of Analysis Boxes include at least one Analysis Box which contains analysis and solutions for shots that go to a strong side of said marksman.

16. The target of claim 1 wherein said plurality of Analysis Boxes include at least one Analysis Box which contains analysis and solutions for shots that are vertically or horizontally stringing.

17. The target of claim 1 wherein said plurality of Analysis Boxes include at least one Analysis Box which contains analysis and solutions for shots that are scattered all over said target.

18. A method for providing automatic feedback in target shooting comprising the steps of:

firing projectiles from a firearm at a target, said target containing a center mass at which said projectiles are aimed, said target further divided into four quadrants, an upper-right quadrant, an upper-left quadrant, an lower-right quadrant and an lower-left quadrant, wherein the intersection of said four quadrants is located in said center mass, said target further containing a plurality of analysis boxes, wherein each said analysis boxes contains text with analysis and solutions to errors in marksmanship;

evaluating the location where said projectiles stuck said target;

correcting said error in marksmanship using information provided in said analysis boxes.

19. The method of claim 18, wherein said firearm is selected from a group consisting of: semi-automatic handguns, revolver handguns, rifles, assault rifles and machine guns.

20. The method of claim 19, wherein said firearm is a semi-automatic handgun.

* * * * *